US005421963A

United States Patent [19]

Stewen et al.

[11] Patent Number: 5,421,963

[45] Date of Patent: Jun. 6, 1995

[54] COKE-FEEDING DEVICE WITH HOUSING FOR A DRY COOLING INSTALLATION FOR COKE

[75] Inventors: Wilhelm Stewen, Oberhausen; Heinz Opdenwinkel, Dortmund; Norbert Dunker, Recklinghausen, all of Germany; Naoto Yasukouchi; Kazushi Kishigami, both of Kitakyushu, Japan

[73] Assignees: Ruhrkohle Aktiengesellschaft, Essen, Germany; Nippon Steel Corporation, Kitayhusu, Japan

[21] Appl. No.: 87,801

[22] PCT Filed: Dec. 27, 1991

[86] PCT No.: PCT/EP91/02515

§ 371 Date: Jul. 8, 1993

§ 102(e) Date: Jul. 8, 1993

[87] PCT Pub. No.: WO92/13043

PCT Pub. Date: Jun. 8, 1992

[30] Foreign Application Priority Data

Jan. 24, 1991 [DE] Germany ..... 41 02 045.6

[51] Int. Cl.[6] ..... C10B 39/02; C10B 39/12

[52] U.S. Cl. ..... 202/263; 202/227; 202/228

[58] Field of Search ..... 202/227, 228, 262, 263

[56] References Cited

U.S. PATENT DOCUMENTS

| | | | |
|---|---|---|---|
| 4,092,222 | 5/1978 | Kataoka et al. | 202/227 |
| 4,358,345 | 11/1982 | Lorrek | 202/228 |
| 4,392,919 | 7/1983 | Galow et al. | 202/228 |
| 4,508,596 | 4/1985 | Weber et al. | 202/227 |

*Primary Examiner*—Joye L. Woodard

*Attorney, Agent, or Firm*—Herbert Dubno; Yuri Kateshov

[57] ABSTRACT

Coke feed device with housing (6) for a coke dry cooling installation which is allocated to a cooling shaft (41) and consists of a stationary hopper (1) with an extraction line (9), a movable hopper (2), a movable, liftable and lowerable cooling shaft closure (8) and the housing (6) containing the movable hopper (2) and the cooling shaft closure (8) which are arranged on a joint chassis (22) running on rails (49). The movable hopper (2, 200, 201) is fitted with a distribution bell (3, 4) and a liftable and lowerable sealing ring (11) and the movable cooling shaft closure (8) fitted with a sealing ring (55) is integrated into a lifting and lowering device (15) and the housing (6, 600, 601) takes the form of a hood clear of the floor or with apertures in the walls (45, 450, 451, 46, 460, 461) for a limited secondary air supply.

10 Claims, 5 Drawing Sheets

COKE-FEEDING DEVICE WITH HOUSING FOR A DRY COOLING INSTALLATION FOR COKE

CROSS REFERENCE TO RELATED APPLICATIONS

This application is a national phase application corresponding to PCT/EP91/02515 filed 27 Dec. 1991 and based, in turn, upon a German application P 41 02 245.6 filed 24 Jan. 1991 under the International Convention.

FIELD OF THE INVENTION

The invention relates to a coke-feeding device with housing for a dry cooling installation for coke, which is assigned to a cooling shaft and comprises a stationary hopper with suction line, a movable hopper, a movable, liftable and lowerable cooling shaft closure, as well as the housing containing the movable hopper and the cooling shaft closure mounted on a common chassis running on rails.

BACKGROUND OF THE INVENTION

The drawback of this installation known from DE-OS 30 04 175 is that during the charging of the cooling shaft with glowing coke a particle separation occurs which leads to an uneven gas flow in the cooling shaft, resulting in a longer dwelling time. A further disadvantage is the additionally required sealing measures. Finally it is disadvantageous that the entire housing is so closely connected with the cooling shaft and the stationary hopper that during the coke charging operation, no air can enter the housing, which can result in a certain explosion risk for the suction line.

It is the object of the invention to provide coke-feeding device avoiding the drawbacks of the prior art, so that no separation occurs during the charging operation. Still another object is to provide a coke-feeding device with the improved ability to lift and lower the cooling shaft closure is the penetration of a certain amount of secondary air into the housing.

SUMMARY OF THE INVENTION

This problem is solved according to the invention by providing the movable hopper with a distribution bell and a liftable and lowerable sealing ring, as well as by integrating the movable cooling shaft closure equipped with a sealing ring in a lifting and lowering mechanism and by designing the housing as a hood with bottom clearance or with openings in the walls in order to allow a limited penetration of secondary air.

The apparatus according to the invention also provides fastening the distribution bell of the movable hopper to a pipe segment which is supported by a crossbeam.

According to another embodiment the distribution bell arranged in the movable hopper is fastened to a cross-shaped support. This structure allows smaller overall dimensions of the movable hopper and the housing.

Preferably the liftable and lowerable sealing ring moves guides and has a lever transmission consisting of lever arms fastened to shafts and weighted down with counterweights, whereby guide rollers arranged on the shafts cooperate with a cam plate in order to lift and lower the sealing ring.

According to a further embodiment the housing is made in two parts, whereby movable longitudinal and transversal sides are assigned to a stationary hood lid, the movable hopper and the cooling shaft closure being solidly integrated therein.

BRIEF DESCRIPTION OF THE DRAWING

The above and other objects, features, and advantages will become more readily apparent from the following description, reference being made to to the accompanying drawing in which:

FIG. 6 is another embodiment of the device according to the

SPECIFIC DESCRIPTION

Figure 1:
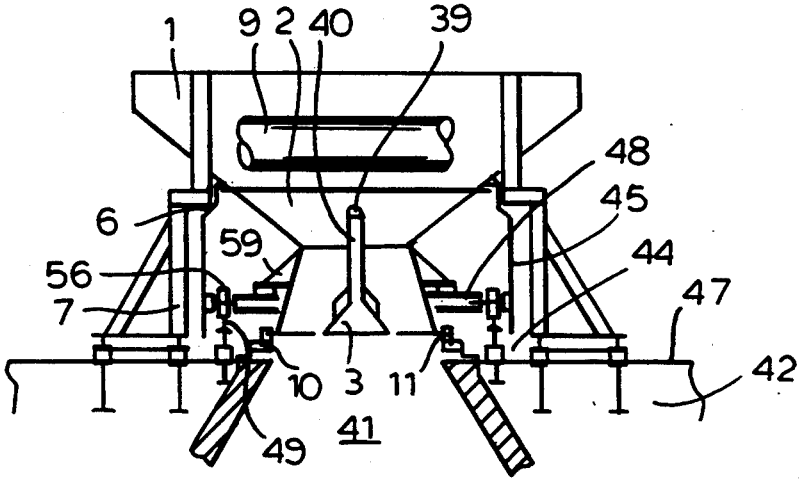
FIG. 1 is a partially sectioned elevational front view of a coke-feeding
Figure 2:
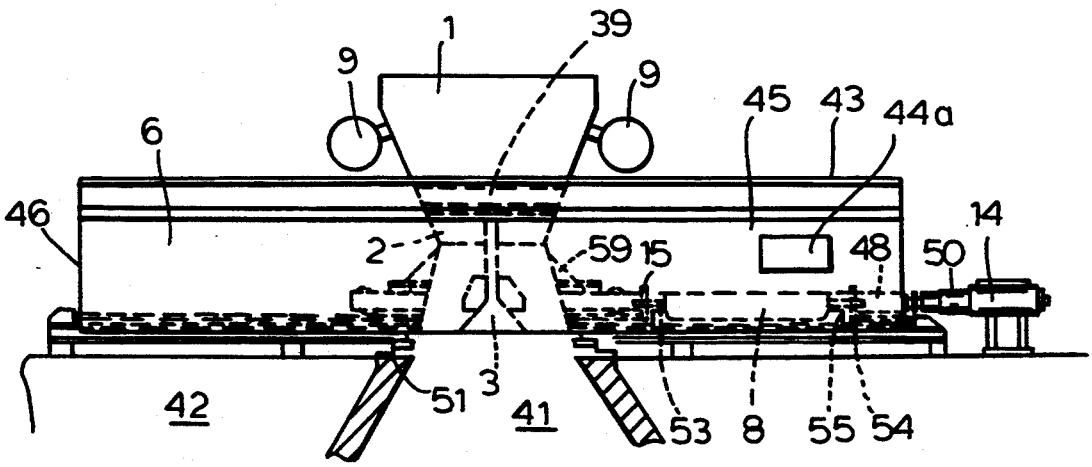
FIG. 2 is a partially sectioned elevational side view of the device shown in FIG. 1.

FIGS. 1 and 2 show a coke-feeding device according to the invention, consisting of a stationary hopper 1 acting in conjunction with a movable hopper 2, which in this illustration is in working position for charging a cooling shaft 41 with glowing coke and is located under the stationary hopper 1. In the movable hopper 2 a distribution bell 3 is arranged, which is fastened to a crossbeam 39 via a pipe segment 40. The crossbeam 39 is anchored in a wall of the movable hopper 2.

The glowing coke coming from a transport container reaches first the stationary hopper 1 and from there the movable hopper 2, where with the aid of the distribution bell 3 an even coke distribution is achieved, avoiding thereby a particle separation in the cooling shaft 41, which would otherwise lead to disadvantages regarding the dimensions and operation of cooling shaft 41.

The stationary hopper is supported by a support structure 7 (FIG. 1), mounted on a platform 42 which is arranged in the upper area of and around the cooling shaft 41. To the stationary hopper 1 a suction line 9 is connected, which aspires the dust generated while the glowing coke is charged, in order to eliminate dust emissions. Also for the elimination of dust emissions serves a housing 6 arranged in the lower area of the stationary hopper 1 and surrounding it sealingly with its hood lid 43. Longitudinal sides 45 and transversal sides 46 of the hood-shaped housing 6 end above the surface 47 of platform 42, so that air slots 44 are left, through which air can be aspired into the inner space of the housing 6, in order to prevent the escape of dust emissions. Instead of air slots 44 openings 44a which are shown diagrammatically in FIGS. 2, 3 and 13, 14 can be provided in the longitudinal sides 45 and/or the transversal sides 46.

Figure 3:
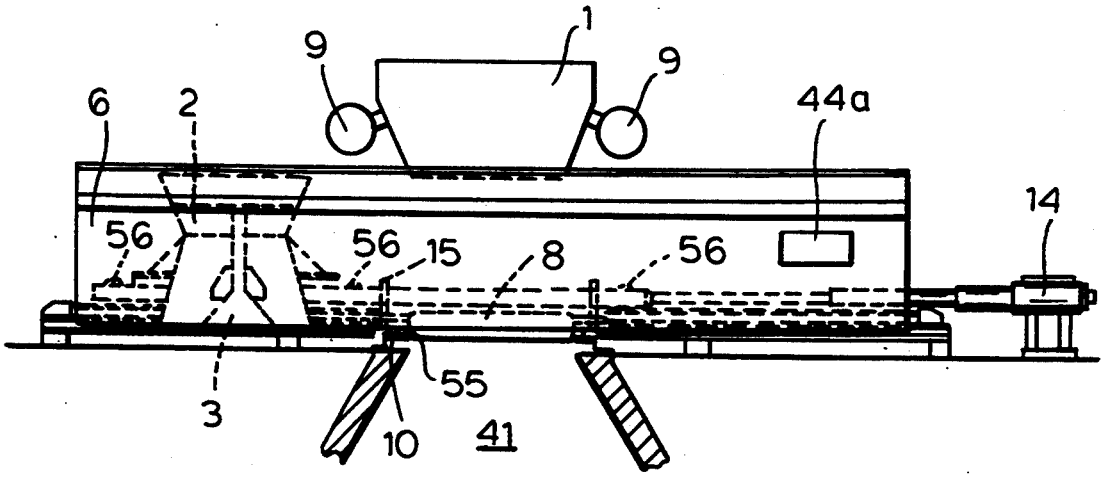
FIG. 3 is a view analogous to the one shown in FIG. 2 but with a cooling shaft closure shown in a sealing position.
Figure 4:
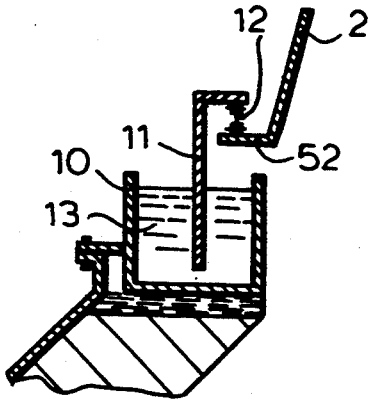
FIG. 4 is the sealing ring arrangement for the movable hopper shown in a closed position.
Figure 5:
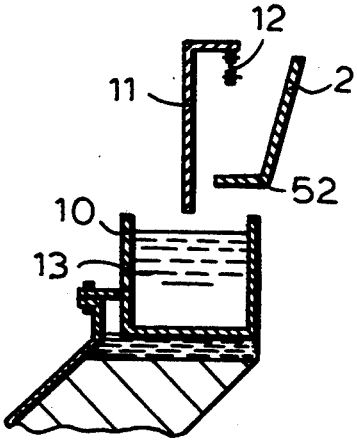
FIG. 5 is the sealing ring arrangement for the movable hopper in an open position.

The housing 6 surrounds a chassis 48 which can move on rails 49 by means of wheels, respectively rollers 56 and which carries on one hand an extension 59 with a movable hopper 2 and on the other hand a cooling shaft closure 8 and a pertaining lift and lowering mechanism 15. The chassis 48 is connected with a drive unit 14, namely in the example over a telescopic linkage 50, by means of which the chassis can be moved from the position shown in FIG. 2 to the position shown in FIG. 3. This happens when the charging operation of the cooling shaft 41 with a charge of glowing coke is finished. Before the start of this operation, a liftable and lowerable sealing ring 11, immersed in water lute 10 filled with water 13 (FIG. 4), has been brought from this sealing position to the release position (FIG. 5). The water lute 10 is arranged above the shaft head 51 of the cooling shaft 41. In its sealing position the sealing ring 11 rests via a flexible sealing element 12 against an annular collar 52 of the movable hopper 2. After the sealing ring 11 is lifted, the movable hopper 2 is moved from its work position according to FIG. 2 in its rest position according to FIG. 3 and at the same time the cooling shaft closure 8 is moved from its rest position (FIG. 2) in a sealing position (FIG. 3). During this operation the dust emissions exiting the cooling shaft 41 remain inside the housing 6 and are aspired from there by the suction line 9. The suction operation has to be continued until the cooling shaft 41 is closely sealed by the cooling shaft closure 8.

The lifting and lowering device 15 for the cooling shaft closure 8 consists of one or more crossrails 53, which are guided and moved up and down in guide and lift elements 54.

After the cooling shaft closure has been brought from its rest position (FIG. 2) to the cooling shaft 41 as a result of the actuation of the telescopic linkage 50 shown in the example, it can be lowered in its sealing position (FIG. 3) by the lifting and lowering mechanism 15. Thereby at the same time a sealing ring 55 mounted on the cooling shaft closure 8 is dipped into the water lute 10, in order to create an emission-free seal for the shaft 41. After the sealing position is assumed, the suction action of the dust aspiration lines 9 can be interrupted.

As soon as the next container with glowing coke is brought to the stationary hopper 1, the suction action of the dust aspiration lines 9 is started again, the cooling shaft closure 8 is lifted again by the lifting and lowering mechanism 15 from its sealing position (FIG. 3) into its moving position and then returned to its rest position (FIG. 2). At the same time the movable hopper 2 reaches again its work position under the stationary hopper 1 (FIG. 2) and after the liftable and lowerable sealing ring 11 is lowered, the next charge of glowing coke can be introduced in the cooling shaft 41.

Figure 6:
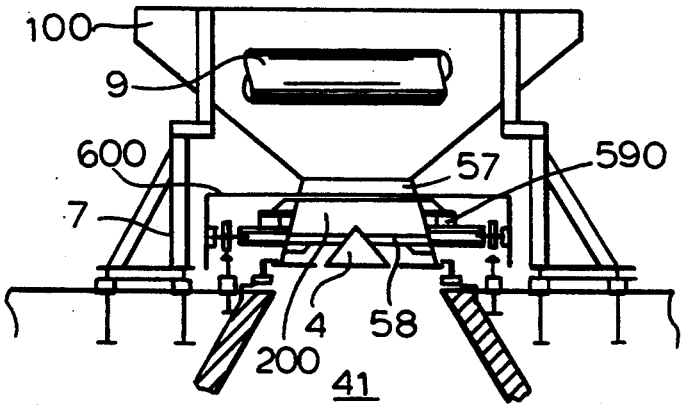
Figure 7:
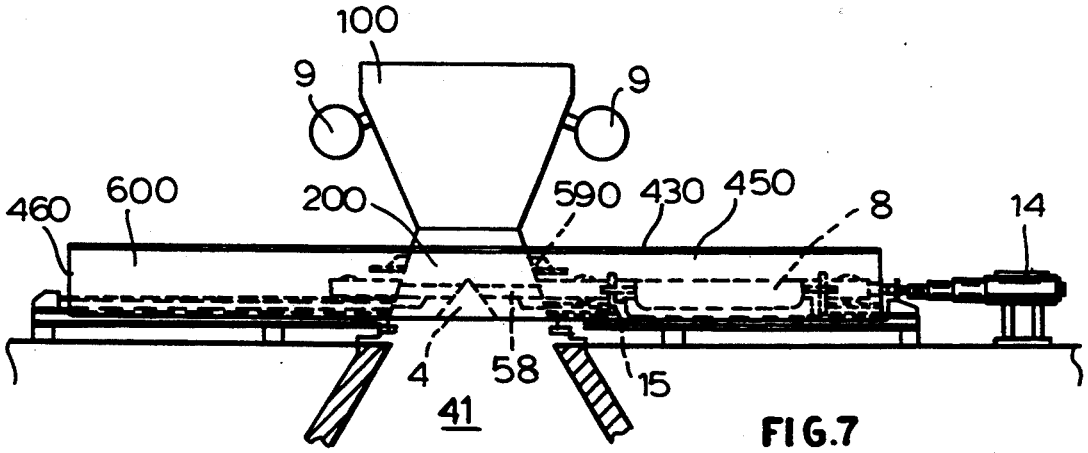
FIGS. 7 and 8 are respective side elevational views of the device shown in FIG. 6 with the shaft closure respectively in working and sealing positions.
Figure 8:
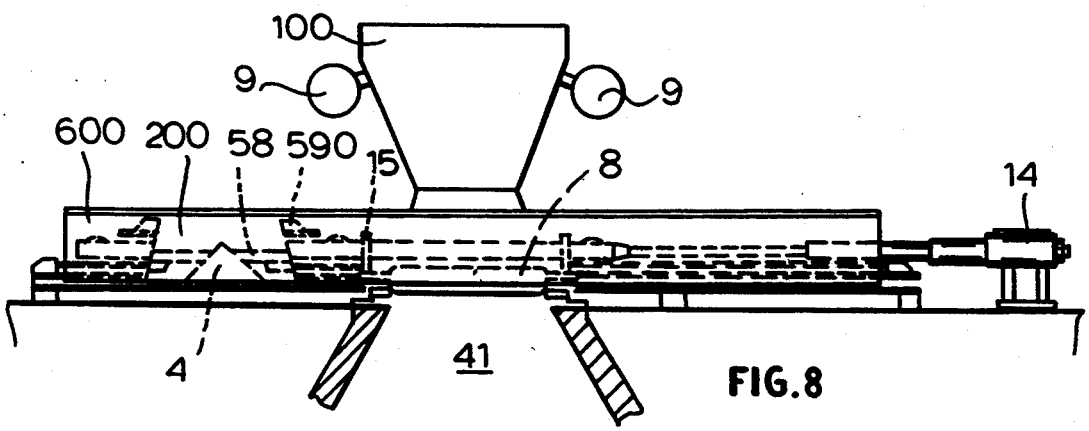

In FIGS. 6, 7 and 8 another embodiment of the coke-feeding device is shown. As can be seen there, it consists of a stationary hopper 100 connected with an enlarged portion 57, sealingly surrounded by a housing 600 formed by a hood lid 430, longitudinal sides 450 and transversal sides 460. The hopper enlargement 57 corresponds with a movable hopper 200, which is fastened via support 590 on the chassis 48 and which comprises a distribution bell 4 fastened to a cross-shaped support anchored in the wall of the movable hopper 200.

Construction and operation of the embodiment of the coke-feeding device according to FIGS. 6, 7 and 8 basically correspond to embodiment according to FIGS. 1, 2 and 3. However, the smaller overall dimensions of the movable hopper 200 and of the housing 600 require less material.

Figure 9:
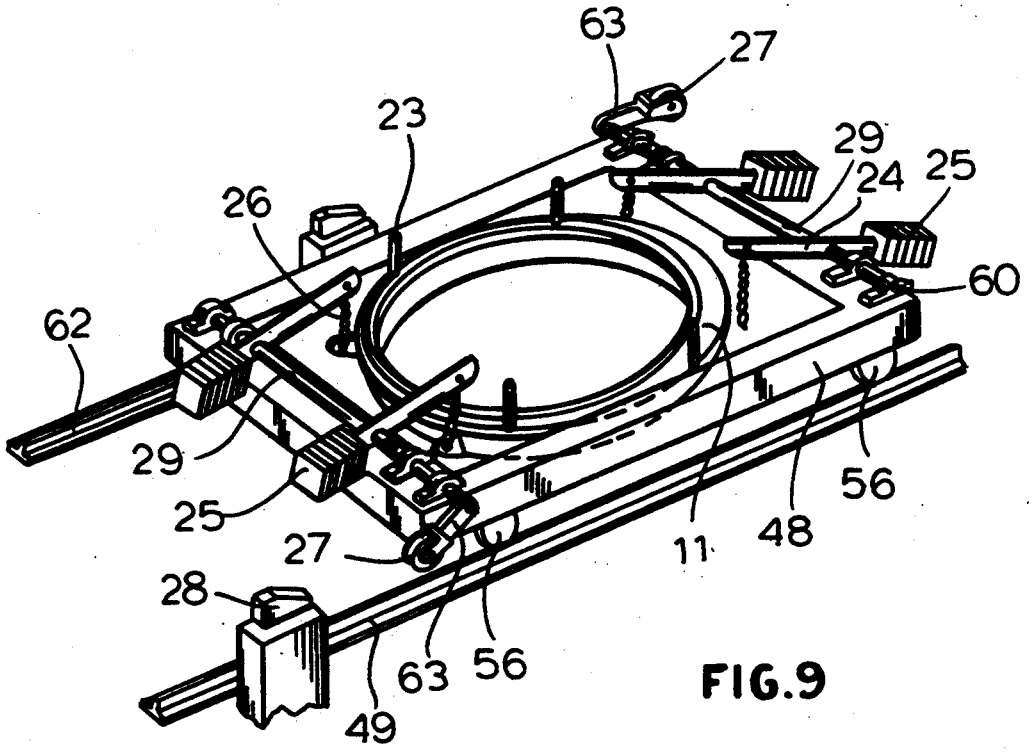
FIG. 9 is an actuation device for the up and down movable sealing ring in a perspective view.
Figure 10:
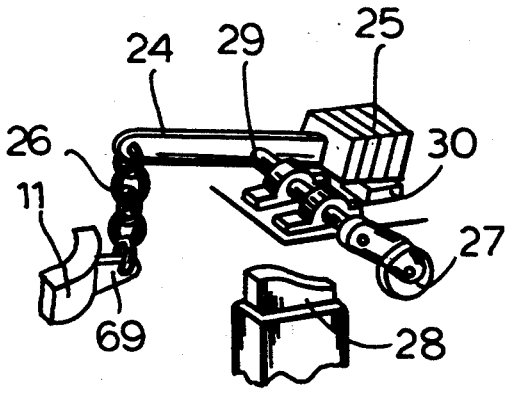
FIGS. 10 and 11 are perspective views of the device of FIG. 9 in raised and lowered positions; stationary hopper as well as with a two-part housing whose lower part is movable.
Figure 11:
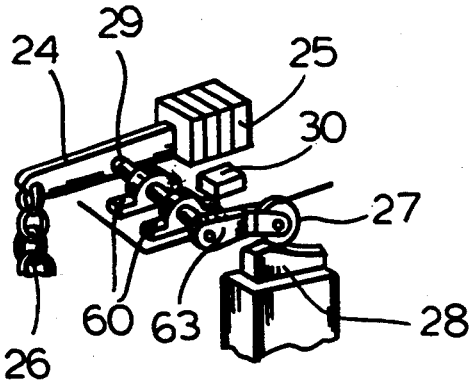

A preferred embodiment of the liftable and lowerable sealing ring 11 is shown in a perspective view in FIGS. 9 to 11. In the example the sealing ring 11 is guided in rod-like guides 23 and carries holding plates 69, to which chains 26 are fastened, which at one end lead to lever arms 24 and at the other end carry counterweights 25. The lever arms 24 are mounted on a shaft 29 movable in bearing blocks 60. The bearing blocks 60 are fastened to a chassis 48 running on rails 49 by means of wheels, respectively rollers 56. At one end of the shafts 29 swivel arms 63 are mounted carrying the guide rollers 27 which act in conjunction with the cam plates 28, as can be seen from FIGS. 10 and 11.

In the raised position of the sealing ring 11 (FIGS. 9 and 10) the counterweights 25 rest on stops 30. In order to reach the sealing position, the chassis 48 is moved over the opening of the cooling shaft 41, whereby the guide rollers 27 are moved up in the area of cam plates 28 and at the same time, due to the rotation of shaft 29, the counterweights 25 are pulled upwards, whereby the sealing ring 11 is lowered in its sealing position. When the reverse motion sequence takes place the sealing ring is correspondingly lifted again by descending the guide rollers 27 from the cam plates 28 and the chassis 48 returns to its rest position.

Figure 12:
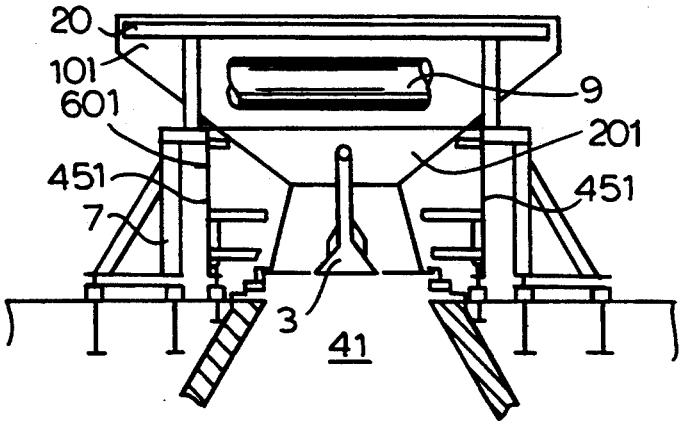
FIG. 12 is still another embodiment of the coke-feeding device according to the invention with a closable stationary hopper as well as with a two-part housing whose lower part is movable.
Figure 13:
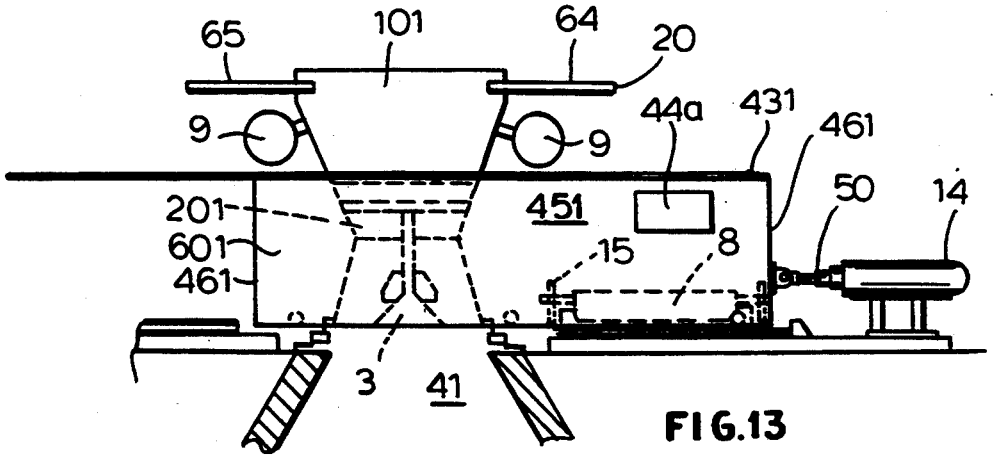
FIGS. 13 and 14, are side elevational views of the device seen in FIG. 12 with the lower part of the housing shown respectively in working/sealing positions.
Figure 14:
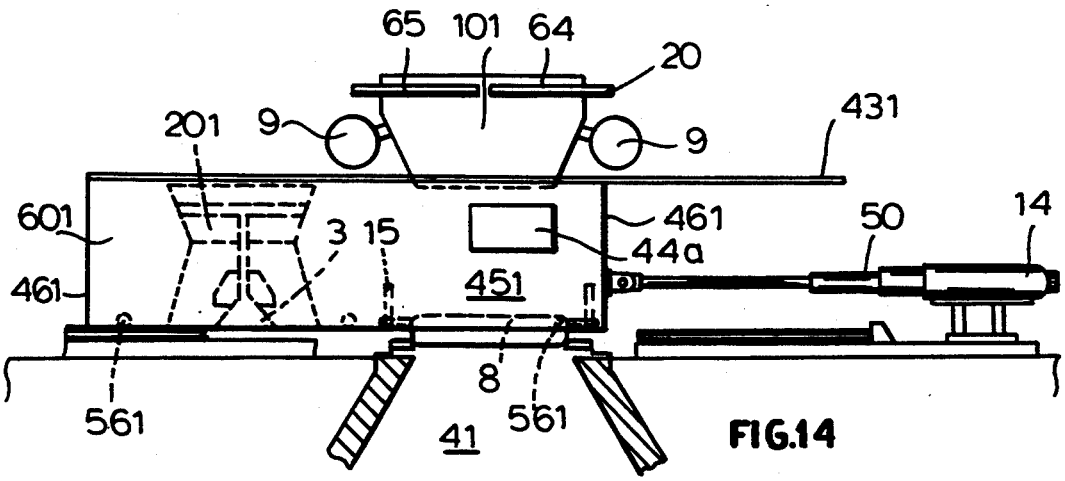

In FIGS. 12 to 14 a further embodiment of the coke-feeding device is represented, consisting of a stationary hopper 101 to which a movable hopper 201 is assigned. On the stationary hopper 101 a hood lid 431 is fastened as a component of a housing 601. Further the housing 601 consists of longitudinal sides 451 and transversal sides 461, which are movably and sealingly guided at the hood lid 431 and which are equipped with wheels, respectively rollers 561 running on rails 491 and which carry the hopper 201 as well as the lifting and lowering mechanism 15 for the cooling shaft closure 8. At one of the side walls 461 the telescopic linkage 50 of the drive unit 14 is connected, with the aid of which the movable part of housing 601 can be displaced.

FIG. 13 shows a position of the housing 601 wherein the movable hopper 201 is shown in work position and the lifting and lowering mechanism 15 with the cooling shaft closure 8 is shown in rest position.

In FIG. 14 a position of the housing 601 is shown wherein the lifting and lowering mechanism 15 with the cooling shaft closure 8 is arranged in sealing position over the cooling shaft 41 and the movable hopper 201 has assumed its rest position.

Figure 15:
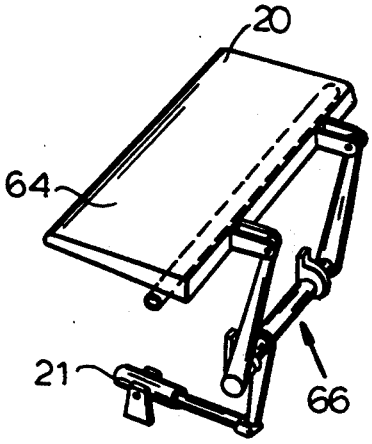
FIG. 15 is an actuation device for the hopper closure in a perspective view.

In this embodiment of the coke-feeding device the stationary hopper 101 is fitted with a hopper closure 20, formed by two closure plates 64 and 65. The actuation device of the hopper closure 20 can be seen from FIG. 15. In the example it consists of a lever linkage 66 and a drive 21. The hopper closure 20 contributes to a further dust emission reduction due to the fact that when the stationary hopper 101 is closed, the cooling shaft closure 8 can be already opened before the container with the glowing coke is deposited on the stationary hopper 101. After the cooling shaft 41 is charged, the charge container can be lifted off earlier, after a previous closing of hopper 101, without unduly impairing the suction of dust emissions through the suction line 9 due to excessive aspiration of secondary air.

We claim:

1. A coke dry cooling installation comprising:

a stationary hopper for receiving the glowing coke and provided with an outlet;

suction means for dust aspiration in said stationary hopper;

a cooling shaft spaced from said hopper and formed with a shaft opening receiving the coke and facing said outlet;

rails mounted between the shaft and said stationary hopper;

a stationary hood surrounding the outlet and extending downwardly toward the rails;

a chassis guidable along the rails in said hood; another hopper mounted in the hood fixedly on the chassis;

actuating means guiding the chassis for displacing the other hopper toward and away from a working position in which the other hopper receives the glowing coke from the outlet;

a bell mounted on the other hopper for even distribution of the coke in the cooling shaft;

a sealing ring movably mounted on the chassis to seal a bottom of the other hopper during receiving the coke therein, said sealing ring being displaceable to unseal the bottom upon ending of receipt of the coke in the other hopper;

shaft closure means mounted on the chassis to move therewith for sealing the shaft opening upon displacing the other hopper on the chassis from the working position and including:

a closure ring, and displacing means for lowering the closure ring to seal the shaft opening and for lifting the closure ring; and supply means formed on the hood for delivering limited access of secondary air preventing escape of the dust.

2. The coke dry cooling installation defined in claim 1 wherein the other hopper further includes:

a crossbeam anchored to the other hopper above the bell, and a pipe segment extending between the bell and the crossbeam and mounted fixedly thereon to support the bell.

3. The coke dry cooling installation defined in claim 1 wherein the chassis is provided with means for displacing the sealing ring between a sealing position corresponding to sealing of the bottom of the other hopper and a rest position, the means for displacing the sealing ring including:

a plurality of bearing blocks mounted on the chassis;

a couple of spaced apart rotatable shafts mounted on the bearing blocks and extending between the rails, each of the shafts being provided with:

a respective pair of spaced apart rollers, a respective pair of spaced apart lever arms, a respective pair of chains connecting one ends of the lever arms to the sealing ring, a respective pair of counterweights mounted on opposite ends of the lever arms; and a plurality of cam plates along the rails engaging the rollers in the working position of the other hopper and forcing the shafts to rotate, so that counterweights are movable upwardly bringing thereby the one ends of the arms along with the chains and sealing ring downwardly from the rest position to the sealing position of the sealing ring.

4. The coke dry cooling installation defined in claim 1 wherein the stationary hopper is provided with a hopper closure.

5. The coke dry cooling installation defined in claim 4 wherein the closure of the stationary hopper comprises with:

a pair of closure plates, and a drive provided with a layer linkage connecting the drive with the plates for displacing the plates between close and open positions of the closure.

6. The coke dry cooling installation defined in claim 1 wherein the supply means includes a plurality of openings formed in the hood.

7. The coke dry installation defined in claim 1 wherein the actuating means includes a telescopic linkage having an end mounted on and urging against the chassis for displacing the chassis along with the other hopper and shaft closure means.

8. The coke dry cooling installation defined in claim 7 wherein the other hopper further includes a cross-shaped support mounted rigidly on the other hopper and supporting the bell.

9. A coke dry cooling installation comprising:

a stationary hopper for receiving the glowing coke and provided with an outlet;

suction means for dust aspiration in said stationary hopper;

a cooling shaft spaced from said hopper and formed with a shaft opening receiving the coke and facing said outlet;

rails mounted between the shaft and said stationary hopper;

a hood mounted guidably along the rails and surrounding the outlet;

another hopper mounted in the hood to be displaceable therewith from a working position of the other hood corresponding to receiving the glowing coke from the outlet;

actuating means guiding the hood for displacing the other hopper toward and away from the working position thereof;

a bell mounted on the other hopper for even distributing of the coke in the cooling shaft;

a sealing ring movably mounted on the hood to seal a bottom of the other hopper during receiving the coke therein, said sealing ring being displaceable to unseal the bottom upon ending of receipt of the coke in the other hopper;

shaft closure means mounted on the hood to move therewith for sealing the shaft opening upon displacing the hood and other hopper from the working position and including;

a closure ring, and displacing means for lowering the closure ring to seal the shaft opening and for lifting the closure ring; and supply means formed on the hood for delivering limited access of secondary air preventing escape of the dust.

10. A coke dry cooling installation comprising:

a stationary hopper for receiving the glowing coke and provided with an outlet;

suction means for dust aspiration in said stationary hopper;

a cooling shaft spaced from said hopper and formed with a shaft opening receiving the coke and facing said outlet;

rails mounted between the shaft and said stationary hopper;

a stationary hood surrounding the outlet and extending downwardly toward the rails so as to leave a bottom clearance;

a chassis guidable along the rails in said hood;

another hopper mounted in the hood on the chassis;

actuating means guiding the chassis for displacing the other hopper toward and away from a working position thereof in which the other hopper receives the glowing coke from the outlet;

a bell mounted on the other hopper for even distribution of the coke in the cooling shaft;

a sealing ring movably mounted on the chassis to seal a bottom of the other hopper during receiving the coke therein, said sealing ring being displaceable to unseal the bottom of the other hopper upon ending of receipt of the coke in the other hopper; and shaft closure means mounted on the chassis to move therewith for sealing the shaft opening upon displacing the chassis with the other hopper from the working position and including:

a closure ring, and displacing means for lowering the closure ring to seal the shaft opening and for lifting the closure ring, wherein the bottom clearance of said hood provides a limited access of secondary air inside the hood to prevent escape of the dust upon charging the glowing coke into the other hopper in the working position thereof.

* * * * *

UNITED STATES PATENT AND TRADEMARK OFFICE

CERTIFICATE OF CORRECTION

PATENT NO. : 5,421,963

DATED : June 6, 1995

INVENTOR(S) : Wilhelm STEWEN et al

It is certified that error appears in the above-identified patent and that said Letters Patent is hereby corrected as shown below:

On the title page: Item[87]

"PCT Pub. Date: Jun. 8, for 1992"

change to read:
-- PCT Pub. Date: Aug. 6, 1992 --

Signed and Sealed this

Twenty-sixth Day of September, 1995

Bruce Lehman

*Attest:*

BRUCE LEHMAN

*Attesting Officer*

*Commissioner of Patents and Trademarks*